United States Patent [19]

Hodges

[11] 4,194,105

[45] Mar. 18, 1980

[54] SWITCHES

[75] Inventor: Robert J. Hodges, Cheshunt, England

[73] Assignee: ITT Industries, Inc., New York, N.Y.

[21] Appl. No.: 759,068

[22] Filed: Jan. 13, 1977

[51] Int. Cl.[2] ..... H01H 13/70

[52] U.S. Cl. ..... 200/159 B; 200/83 B; 200/275

[58] Field of Search ..... 200/83 R, 83 B, 83 N, 200/159 B, 275

[56] References Cited

U.S. PATENT DOCUMENTS

| | | | |
|---|---|---|---|
| 1,974,779 | 9/1934 | Lupold et al. | 200/83 N |
| 2,111,168 | 3/1938 | Chansor | 200/83 N |
| 2,381,582 | 8/1945 | Erickson | 200/83 N X |
| 2,798,130 | 7/1957 | Cox | 200/83 N |
| 3,996,429 | 12/1976 | Chu et al. | 200/275 X |
| 4,029,916 | 6/1977 | Chu | 200/159 B X |

FOREIGN PATENT DOCUMENTS

| | | | |
|---|---|---|---|
| 2284177 | 5/1976 | France | 200/159 B |
| 1361459 | 7/1974 | United Kingdom | 200/159 B |

*Primary Examiner*—James R. Scott

*Attorney, Agent, or Firm*—James B. Raden; William J. Michals

[57] ABSTRACT

An electrical switch contact member consists of a resilient electrically conductive domed diaphragm of a predetermined shape. The diaphragm includes a frusto-conical region linking a central region of the diaphragm with a peripheral region. The frusto-conical region includes an inwardly turned or bent transition portion at its smaller end, and an outwardly turned transition portion at its larger end, and is dimensioned to function as a Belleville spring. The diaphragm may also comprise a plurality of co-axial similarly oriented frusto-conical regions each of which is inwardly turned at its smaller end, outwardly at its larger end, and which is also dimensioned to function as a Belleville spring.

2 Claims, 2 Drawing Figures

SWITCHES

BACKGROUND OF THE INVENTION

This invention relates to electrical switches and, more particularly, to such switches including a domed diaphragm of a resilient electrically conductive material which is arranged to function as a semi-stable spring.

In a preferred embodiment of the present invention the diaphragm is arranged as a Belleville spring. A useful feature of Belleville springs is that by suitable choice of dimension (as set forth in the design book entitled Spring Design and Application, Chironis, Mc Graw-Hill, publishers), they can be made to have a region of negative spring rate operation which, in a switch, may be utilized to provide snap action. It is to be understood however that the feature of snap action is not essential to the present invention.

SUMMARY OF THE INVENTION

According to the present invention there is provided an electrical switch contact member consisting of a resilient, electrically conductive, domed diaphragm being formed of one or more co-axial oriented frusto-conical regions linking a central region of the diaphragm with a peripheral region. Each frusto-conical region being inwardly turned at its smaller end and outwardly turned at its larger end and being dimensioned to function as a Belleville spring.

BRIEF DESCRIPTION OF THE DRAWING

There follows a description of two embodiments of the invention, the first being a key-block of single pole snap action switches, and the second being an embodiment in a two-position, fluid pressure actuated switch arrangement. The following description refers to the accompanying drawing, in which.

DETAILED DESCRIPTION

Figure 1:
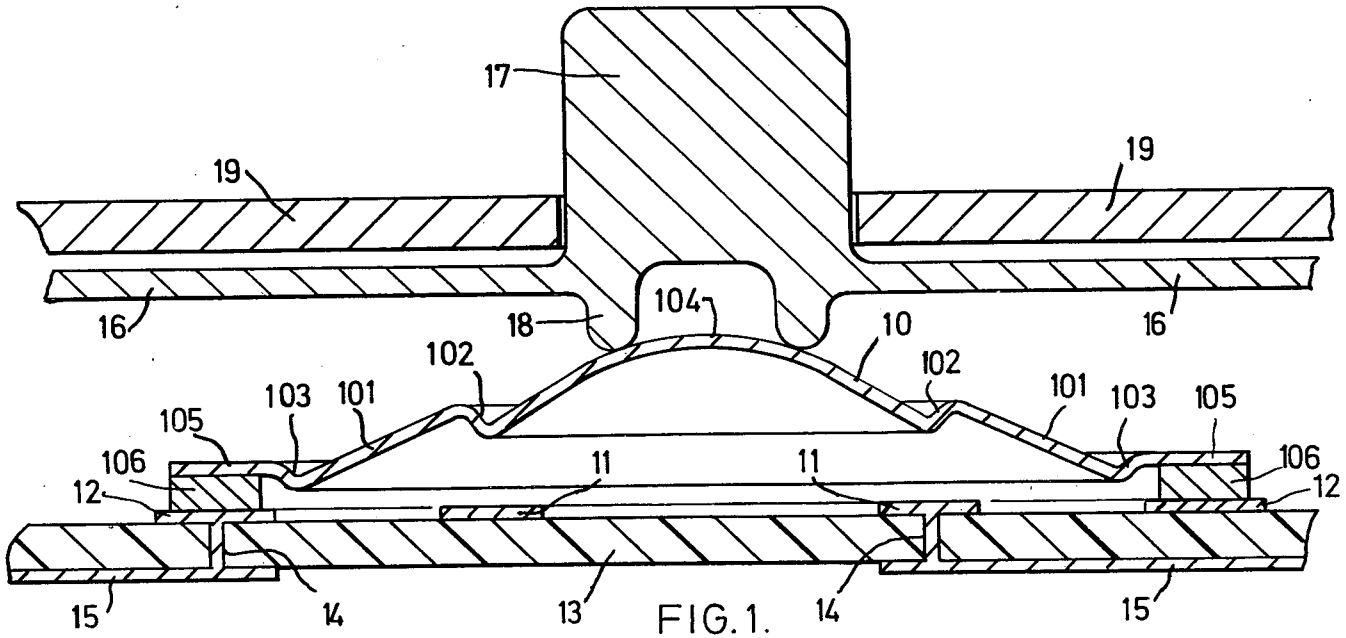
FIG. 1 depicts a section through part of a key-block switch.

FIG. 1 shows a section through one of the push button switches of a key block. Each switch of the key block is a single make contact switch in which depression of a suitable profiled resilient domed diaphragm 10 establishes bridging electrical connection between annular tracks 11 and 12 on a printed circuit board 13. Through connections 14 provide electrical connection between track 11 and 12 and other tracks is on the other side of the printed circuit board.

The domed diaphragm 10 has a frusto-conical region 101 which is linked by swan-necked regions 102 and 103 with a central domed region 104 and a peripheral region 105. The region 102 and the annular track 11 constitute the operating contacts of the switch. The peripheral region 105 is secured to an electrically conductive annular spacer 106, which in turn is secured to the annular track 12. The diaphragm is typically made of a nickel-iron-chromium alloy, or of berylium copper, or phosphor bronze. The dimensions of the frusto-conical region 101 are chosen so that it functions as a Belleville spring exhibiting negative spring action. The thickness of the spacer 106 is chosen to prevent the Belleville spring from snapping through center to the other of its stable positions. Instead, when the spring snaps over, the movement is arrested by the swan-necked region 102 coming into contact with the annular track 11. This track 11 and either the swan-necked region 102 or the entire inner surface of the diaphragm are plated to improve their electrical contact making properties. Typically the plating consists of hard gold on a nickel interlayer.

After the array of diaphragms have been secured to the printed circuit board it is covered by a resilient neoprene moulding 16 incorporating an array of touch-buttons 17 registering with the array of diaphragms. The underside of each push button is provided with a raised annular ridge 18 that in operation of the switch bears on the central domed region 104 of the diaphragm. The resilience of the push buttons is such that when a push button is depressed sufficiently to take the underlying diaphragm to the zero spring rate position of its frusto-conical region 101, the compression of the push button is sufficient to snap the diaphragm into contact with the inner annular track 11 thus precluding the possibility of a slow make of contact. The same resilience similarly precludes slow break of contact.

The push buttons are inserted through the apertures of a key block escution 19 to which the printed circuit board is then attached thereby trapping the moulding in position.

Figure 2:
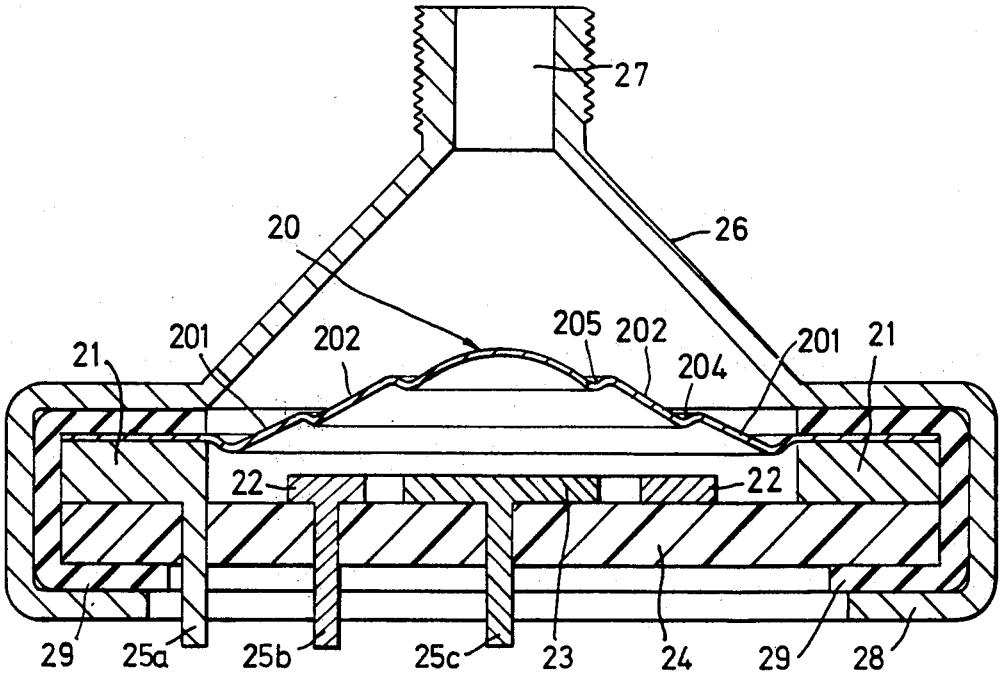
FIG. 2 depicts a section through a two position fluid pressure actuated switch.

FIG. 2 shows a section through a two position fluid pressure actuated switch. In this switch a suitable profiled domed diaphragm 20 is used to establish bridging electrical connection between outer and inner contact rings 21 and 22 at a first applied pressure, and then at a higher pressure to establish a further bridging electrical connection between the rings 21 and 22 and an inner contact 23. The contact rings and inner contact are secured to an insulator board 24 and are provided with **25*a*, 25*b*, and 25*c* extending through the board 24** to which terminal connection may be made.

The design and construction of the diaphragm 20 is substantially the same as that of the diaphragm 10 described above with reference to the key block switch. The major difference is that the diaphragm 20 has two frusto-conical regions 201 and 202 instead of one. These regions, which function as Belleville spring, are dimensioned so that they both exhibit negative spring action, and so that the spring 201 snaps over at a lower applied force than that necessary to cause spring 202 to snap over. When the spring 201 starts to snap over its movement is arrested by the swan-necked region 204 linking the two springs coming into contact with the inner contact ring 22. When the spring 202 starts to snap over its movement is arrested by the swan-necked region 205, linking the spring 202 with the domed central region of the diaphragm, coming into contact with the inner contact 23.

The diaphragm 20 and the insulator board 24 are mounted in a steel housing or casing 26 provided with a screw-threaded orifice 27 for connection to a pressure system. The casing also has a swaging ring 28 under which is located a rubber annulus 29 which acts as a seal when the ring 28 is swaged over the edge of the insulator board to fasten the assembly together.

When the pressure switch is connected into a pressure system the working fluid of the pressure system is able to enter the body of the switch through the orifice 27 and acts directly on the diaphragm 20. The two Belleville springs 201 and 202 are dimensioned so that spring 201 snaps over and establishes electrical contact between lugs **25*a* and 25*b* at a pre-determined pressure equal to the minimum service pressure of the system, while spring 202 snaps over at a predetermined higher pressure equal to the maximum service pressure of the system thereby establishing electrical connection between lug 25***a* and the other two lugs 25*a* and 25*b*.

It is to be understood that the foregoing description of specific examples of this invention is made by way of example only and is not to be considered as a limitation on its scope.

What is claimed is:

1. An electrical switch assembly having a generally dome-shaped diaphragm of electrical conductive and resilient material and being deformable from a stable position to an instable position, a portion of said diaphragm engaging at least one switch contact for completing an electrical circuit, wherein said diaphragm includes a central portion, a peripheral portion and an intermediate frusto-conic portion joining said central and peripherial portions, the transition region between said peripherial portion and said frusto-conic portion is turned away from a first side of the conical surface plane of said frusto-conic portion and the transition region between said central portion and said frusto-conic portion is turned away from the opposite side of said conical surface plane of said frusto-conic portion, one of said transition regions engaging said switch contact for completing said electrical circuit, and the resilient spring characteristics of said diaphragm being controlled by the dimension of said frusto-conic portion between said central and peripherial portions; and means including said one of said transition portions and said switch contact for limiting the deformation translation of said diaphragm in the direction of said instable position thereby to ensure the return translation of said diaphragm back to said stable position.

2. The switch assembly according to claim 1, wherein said frusto-conic portion includes n transition regions intermediate the ends thereof and dividing said frusto-conic portion into n+1 intermediate frusto-conic portions, each intermediate frusto-conic portion including oppositely directed turned end portions and wherein n is an integer.

* * * * *